US011779184B2

(12) United States Patent
Li et al.

(10) Patent No.: US 11,779,184 B2
(45) Date of Patent: Oct. 10, 2023

(54) CLEANING ASSEMBLY

(71) Applicant: Jiaxing J-Creation Intelligent Electric Appliance Co., Ltd., Jiaxing (CN)

(72) Inventors: Jing Li, Jiaxing (CN); Hao Chen, Jiaxing (CN); Hongwei Liu, Jiaxing (CN)

(73) Assignee: Jiaxing J-Creation Intelligent Electric Appliance Co., Ltd., Jiaxing (CN)

( * ) Notice: Subject to any disclaimer, the term of this patent is extended or adjusted under 35 U.S.C. 154(b) by 338 days.

(21) Appl. No.: 16/879,798

(22) Filed: May 21, 2020

(65) Prior Publication Data

US 2020/0397205 A1 Dec. 24, 2020

(30) Foreign Application Priority Data

Jun. 19, 2019 (CN) ..... 201920924643.3
Oct. 22, 2019 (CN) ..... 201921773767.2
Oct. 22, 2019 (CN) ..... 201921780005.5

(51) Int. Cl.
*A47L 11/40* (2006.01)
*A47L 11/283* (2006.01)

(52) U.S. Cl.
CPC ..... *A47L 11/4027* (2013.01); *A47L 11/283* (2013.01); *A47L 11/4038* (2013.01); *A47L 11/4041* (2013.01); *A47L 11/4088* (2013.01)

(58) Field of Classification Search
CPC ..... A47L 11/283; A47L 11/16–161; A47L 11/2025; A47L 11/206; A47L 11/293;
(Continued)

(56) References Cited

U.S. PATENT DOCUMENTS 9,907,449 B2 * 3/2018 Lu ..... A47L 11/4044
2018/0028040 A1 * 2/2018 Delangue ..... A47L 13/58
(Continued)

FOREIGN PATENT DOCUMENTS

CN 106491056 A * 3/2017
CN 106491056 A 3/2017
(Continued)

OTHER PUBLICATIONS

Translated description of WO2018012912A1 (Year: 2022).*
(Continued)

*Primary Examiner* — Don M Anderson
*Assistant Examiner* — Sarah Akyaa Fordjour
(74) *Attorney, Agent, or Firm* — Bayramoglu Law Offices LLC

(57) ABSTRACT

A cleaning assembly including a floor scrubber and a self-cleaning device matched with the floor scrubber is provided. The floor scrubber includes a housing connected to a handle. A motor is arranged in the housing. A scrubbing disc is arranged below the housing and is driven by the motor to rotate. The self-cleaning device includes a barrel connected to a support member used for supporting the floor scrubber. A wiper member is arranged in the barrel. When the floor scrubber is placed in the barrel to be dried, the support member supports the floor scrubber, and the wiper member abuts against the scrubbing disc; and when the scrubbing disc rotates or the wiper member moves, water and/or dirt on the scrubbing disc are/is wiped off by the wiper member.

13 Claims, 10 Drawing Sheets

(58) Field of Classification Search
CPC .... A47L 11/305; A47L 11/4038; A47L 13/58; A46B 17/06
See application file for complete search history.

(56) References Cited

U.S. PATENT DOCUMENTS

| | | | | |
|---|---|---|---|---|
| 2019/0216287 | A1* | 7/2019 | Zhu | A47L 13/60 |
| 2021/0330166 | A1* | 10/2021 | Wu | A47L 11/4038 |

FOREIGN PATENT DOCUMENTS

| | | | | | |
|---|---|---|---|---|---|
| CN | 108852212 | A | * | 11/2018 | A47L 13/58 |
| KR | 101024627 | B1 | * | 1/2011 | |
| WO | WO-2018012912 | A1 | * | 1/2018 | A47L 11/14 |
| WO | WO-2019056997 | A1 | * | 3/2019 | A47L 13/256 |

OTHER PUBLICATIONS

Tranlsation of WO-2019056997-A1 (Year: 2022).*
Machine translation CN-106491056-A (Year: 2022).*
Machine translation of CN-108852212-A (Year: 2022).*
Machine translation of KR101024627B1 (Year: 2022).*
Machine translation CN-106491056-A (Year: 2023).*
Machine translation of KR101024627B1 (Year: 2023).*

* cited by examiner

CLEANING ASSEMBLY

CROSS REFERENCE TO THE RELATED APPLICATIONS

This application is based upon and claims priority to Chinese Patent Applications No. 201920924643.3, filed on Jun. 19, 2019, No. 201921773767.2, filed on Oct. 22, 2019, and No. 201921780005.5, filed on Oct. 22, 2019, the entire contents of which are incorporated herein by reference.

TECHNICAL FIELD

The invention relates to a cleaning assembly including a floor scrubber and a self-cleaning device matched with the floor scrubber, and belongs to the technical field of cleaning tools.

BACKGROUND

A domestic electrical floor scrubber, provided by an existing patent document Publication No. CN106491056A, adopts a double-disc structure to effectively improve the cleaning effect and to bring great convenience to users during cleaning. However, after floors are cleaned, scrubbing discs of the floor scrubber generally have to be manually wiped or have to be disassembled to be washed with water, which causes trouble and inconvenience to users.

SUMMARY

The objective of the invention is to overcome the defects of the prior art by providing a floor scrubber which is reasonable in structural design and convenient to clean, and a self-cleaning device matched with the floor scrubber.

The technical solution adopted by the invention is to provide a cleaning assembly including a floor scrubber and a self-cleaning device matched with the floor scrubber. The floor scrubber comprises a housing connected to a handle, wherein a motor is arranged in the housing, and a scrubbing disc is arranged below the housing and is driven by the motor to rotate. The self-cleaning device comprises a barrel, wherein the barrel is connected to a support member used for supporting the floor scrubber, and a wiper member is arranged in the barrel; when the floor scrubber is placed in the barrel to be dried, the support member supports the floor scrubber, and the wiper member abuts against the scrubbing disc; and when the scrubbing disc rotates or the wiper member moves, water and/or dirt on the scrubbing disc are/is wiped off by the wiper member.

Wherein, an even number of scrubbing discs are arranged and are divided into two symmetrical groups, and the two groups of scrubbing discs rotate in opposite directions.

Wherein, the support member is arranged in the barrel.

Wherein, the support member is arranged above the barrel, the handle is provided with a hanging part, and the support member is connected to the hanging part to support the floor scrubber.

Wherein, the scrubbing disc is a circular disc and is able to rotate, and the wiper member is maintained in the barrel.

Wherein, the scrubbing disc is a circular disc, and the wiper member is rotatably arranged with the center of the scrubbing disc as a rotation point.

Wherein, the wiper member is a wiper strip, a roller, or a brush, or any combination of the wiper strip, the roller and the brush.

Wherein, the wiper member is a roller which is rotatably arranged in the barrel with the self axis as a rotation axis and is able to rotate in one direction; when the scrubbing disc rotates forward, the roller rotates synchronously; and when the scrubbing disc rotates reversely, the roller stops rotating.

Wherein, the self-cleaning device further comprises a ratchet mechanism used for realizing unidirectional rotation of the roller.

Wherein, the self-cleaning device further comprises a mounting base, a rotary shaft is arranged at the end of the roller and is provided with ratchet teeth, the mounting base is provided with convex teeth and a cavity, the rotary shaft is arranged in the cavity, and the cavity has a movement space allowing the rotary shaft to move therein; when the scrubbing disc rotates forward, the rotary shaft rolls away from the convex teeth; and when the scrubbing disc rotates reversely, the rotary shaft rolls towards the convex teeth to allow the convex teeth to be inlaid into the ratchet teeth, so that the roller is made to stop rotating.

Wherein, the scrubbing disc comprise a scrubbing part and a mounting disc used for mounting the scrubbing part, the motor is connected to the mounting disc, and the scrubbing part is detachably arranged on the mounting disc.

Wherein, the scrubbing disc comprise a scrubbing part and a mounting disc used for mounting the scrubbing part, the motor is connected to the mounting disc, and scrubbing part is sewn on the mounting disc.

Wherein, the self-cleaning device comprises a water supply device used for supplying water to the scrubbing disc, the water supply device comprises a water pump, and when the scrubbing disc is to be cleaned with water, the water pump operates to pump water from the barrel or from a water storage cavity isolated from the barrel to the scrubbing disc.

Wherein, the self-cleaning device further comprises a water supply device, the water supply device comprises a water receiver connected to the barrel and located above the scrubbing disc, and the water receiver is provided with a water outlet connected to a water valve; when the scrubbing disc is to be cleaned with water, the water valve is opened to supply water to the scrubbing disc via the water outlet; and water and/or dirt wiped off from the scrubbing disc by the wiper member are/is received in the barrel.

Wherein, the water pump operates to pump water from the water storage cavity isolated from the barrel to the scrubbing disc, and water and/or dirt wiped off from the scrubbing disc by the wiper member are/is received in the barrel.

Wherein, the water pump comprises a cylinder provided with a water inlet, a spiral blade which spirally extends along the inner wall of the cylinder from bottom to top is arranged in the cylinder, the cylinder is able to rotate with respect to the barrel, the scrubbing disc is arranged above the cylinder, and the cylinder is driven to rotate when the scrubbing disc rotates.

Wherein, the inner diameter of the cylinder is gradually increased from bottom to top.

Wherein, the support member is fixedly connected to the cylinder.

Wherein, an inner cylinder is arranged in the cylinder, a gap is reserved between the inner cylinder and the cylinder, and the inner cylinder is coaxial with the cylinder and is fixedly or rotatably connected to the cylinder.

Wherein, the inner cylinder is fixedly connected to the cylinder, and the support member is fixedly connected to the inner cylinder.

Compared with the prior art, the invention has the following advantages and effects: the floor scrubber and the self-cleaning device are used in cooperation, so that the problems that the floor scrubber is difficult to clean and difficult to dry after being cleaned are solved.

DETAILED DESCRIPTION OF THE EMBODIMENTS

Figure 1:
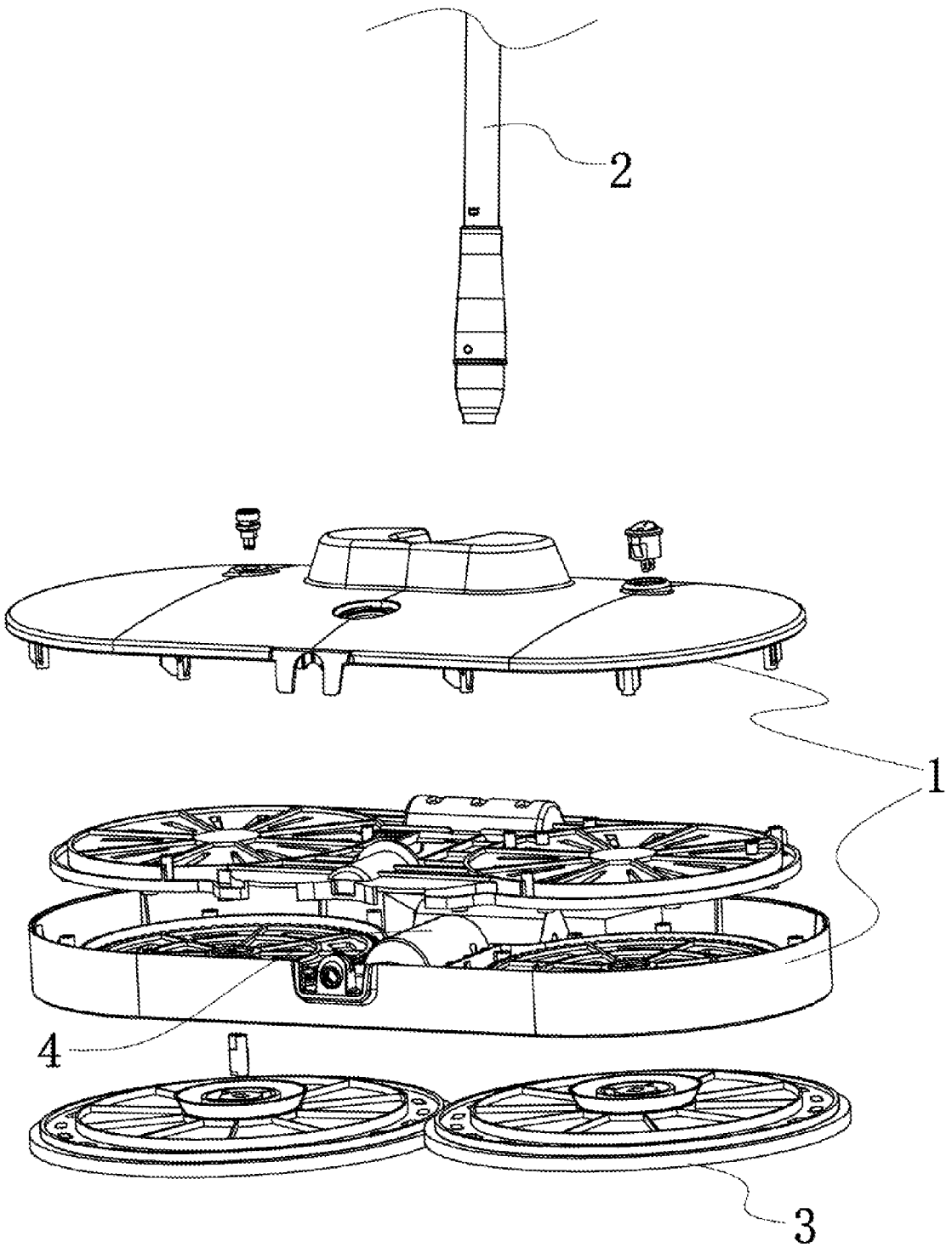
FIG. 1 is a structural diagram of a floor scrubber in one embodiment.
Figure 2:
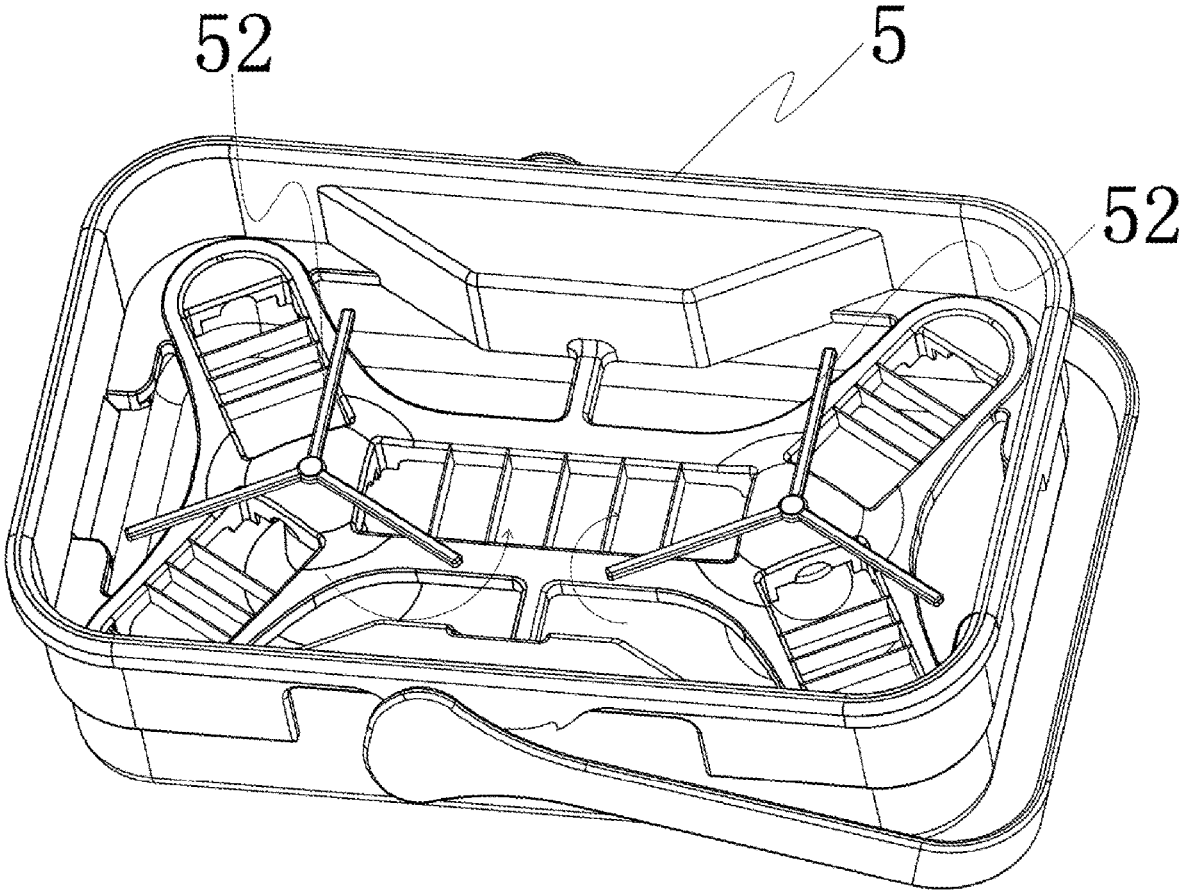
FIG. 2 is a structural diagram of a self-cleaning device matched with the floor scrubber.
Figure 3:
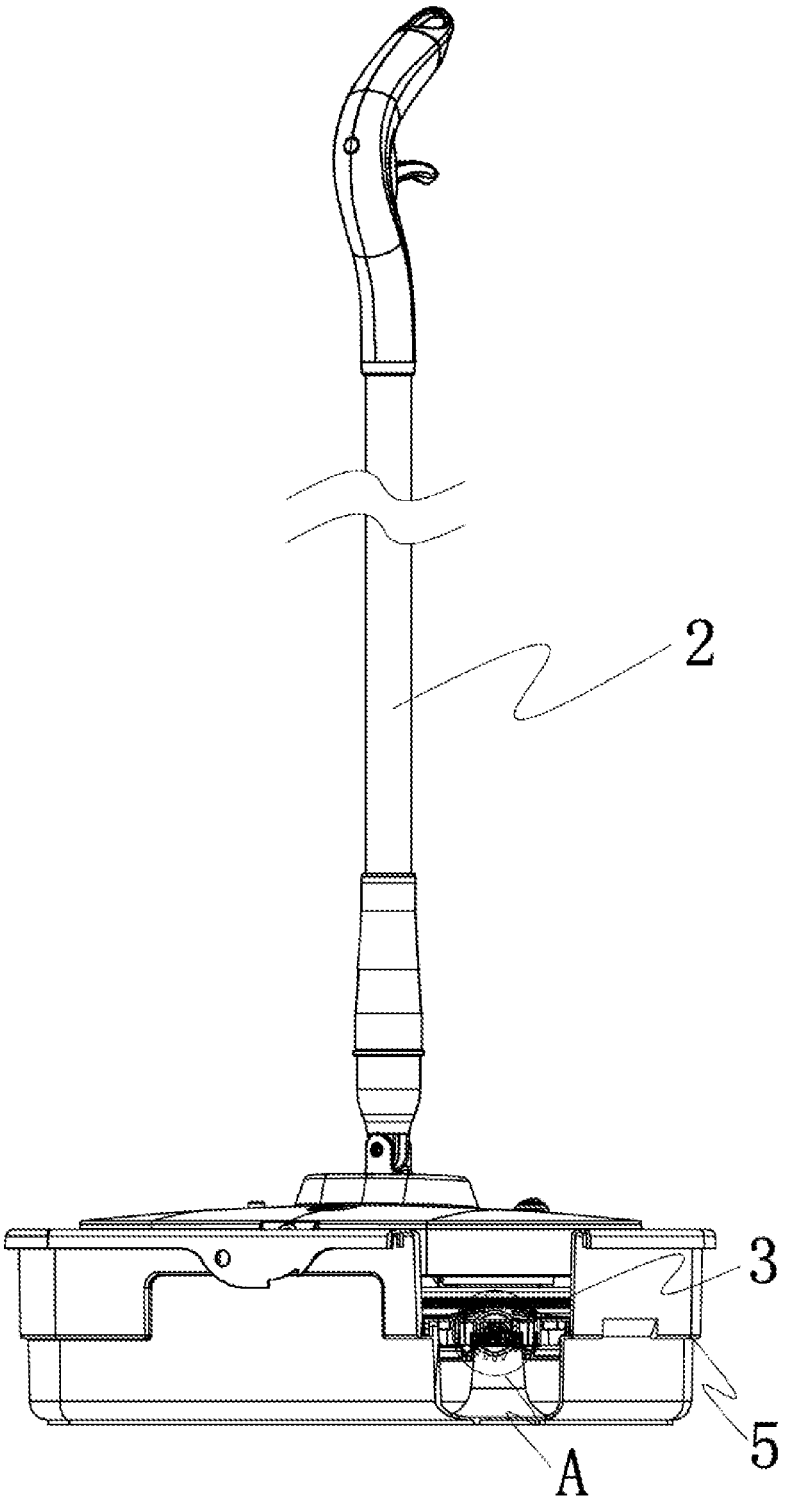
FIG. 3 is a structural diagram of the floor scrubber placed in a barrel in the embodiment.

The invention is further described below in combination with the accompanying drawings.

Embodiment 1

Referring to FIG. 1 to FIG. 4, this embodiment provides a cleaning assembly including a floor scrubber and a self-cleaning device matched with the floor scrubber. The floor scrubber comprises a housing 1 connected to a handle 2, wherein a motor 4 is arranged in the housing 1, a scrubbing disc 3 is arranged below the housing 1 and is driven by the motor 4 to rotate, and in an implementation, the motor 4 drives the scrubbing disc 3 in a manner of the prior art, for example, the motor 4 is directly connected to the scrubbing disc 3 and rotates to drive the scrubbing disc 3 to rotate, or the motor 4 drives the scrubbing disc 3 through a gear, or the motor 4 drives the scrubbing disc 3 through a gear and a worm gear; and those skilled in the art can select the specific implementation as actually needed. This embodiment further provides the self-cleaning device matched with the floor scrubber. The self-cleaning device comprises a barrel 5 connected to a support member 51 used for supporting the floor scrubber, wherein a wiper member 52 is arranged in the barrel 5; when the floor scrubber is placed in the barrel 5 to be dried, the support member 51 supports the floor scrubber, and the wiper member 52 abuts against the scrubbing disc 3; when the scrubbing disc 3 rotates, water and/or dirt on the scrubbing disc 3 are/is wiped off by the wiper member 52; or, the wiper member 52 rotates or moves horizontally to wipe off water and/or dirt from the scrubbing disc 3. Preferably, when the self-cleaning device in this embodiment is used, the scrubbing disc 3 is soaked in water or is sprayed with water to be wetted first, then the floor scrubber is placed in the barrel 5 to operate as if the floor scrubber is used for scrubbing a floor, and the scrubbing disc 3 is cleaned in this process; or, the floor scrubber is placed in the barrel 5, and then the wiper member 52 moves to clean the scrubbing disc 3. Compared with manual disassembly and cleaning, the self-cleaning device in this embodiment can achieve cleaning conveniently and rapidly.

Preferably, an even number of scrubbing discs 3 are arranged and are divided into two symmetrical groups, and the two groups of scrubbing discs 3 rotate in opposite directions. In a specific implementation, the number of the scrubbing discs 3 is two, the two scrubbing discs 3 are driven by one or two motors 4 through gears, one of the two scrubbing discs 3 rotates clockwise, and the other scrubbing disc 3 rotates anticlockwise.

Preferably, the support member 51 is arranged in the barrel 5 and can be specifically implemented as follows: first, the support member 51 is arranged in the barrel 5 and is supported by the bottom of the barrel 5; second, the support member 51 is supported on the side wall of the barrel 5 and extends towards the middle of the barrel 5. Both implementations are feasible. The side wall of the barrel 5 is surrounded by the support member 51, so that water is prevented from splashing out.

Figure 4:
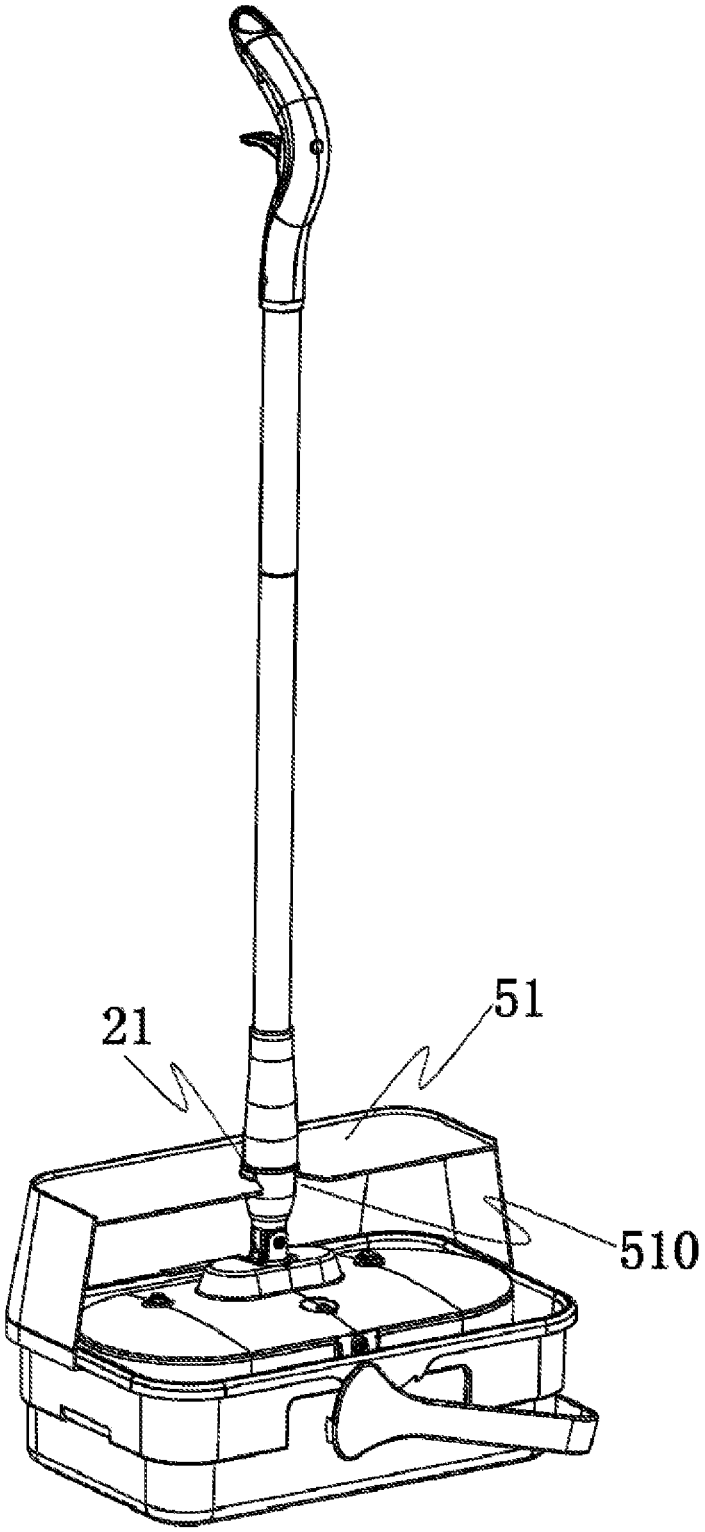
FIG. 4 is a structural diagram of another implementation of a support member in the embodiment.

As shown in FIG. 4, in a preferred implementation, the support member 51 is arranged above the barrel 5, a hanging part 21 is arranged on the handle 2, and the support member 51 is connected to the hanging part 21 to support the floor scrubber. Particularly, the support member 51 is a hook, and the hanging part 21 on the handle 2 is firmly hooked on the hook, so that the floor scrubber is supported; or, the support member 51 is formed with a hole 510 having an outer diameter smaller than the hanging part 21 and greater than the handle 2, an opening is formed in one side of the hole 510, the handle 2 enters the hole 510 via the opening, then moves downwards, and finally is limited due to the fact that the outer diameter of the hanging part 21 is greater than that of the hole 510, and thus, the floor scrubber is supported.

Preferably, the scrubbing disc 3 is a circular disc and is able to rotate, the wiper member 52 is arranged at a fixed position in the barrel and does not synchronously rotate in the same direction with the scrubbing disc 3, and the scrubbing disc 3 and the wiper member 52 can move relatively.

Preferably, in this embodiment, the scrubbing disc 3 is a circular disc, and the wiper member 52 is rotatably arranged with the center of the scrubbing disc 3 as a rotation point. In another implementation, the wiper member 52 rotates to wipe off water and/or dirt from the scrubbing disc 3, and the wiper member 52 is manually driven to rotate, or the wiper member 52 is driven by another motor 4 to rotate.

Figure 5:
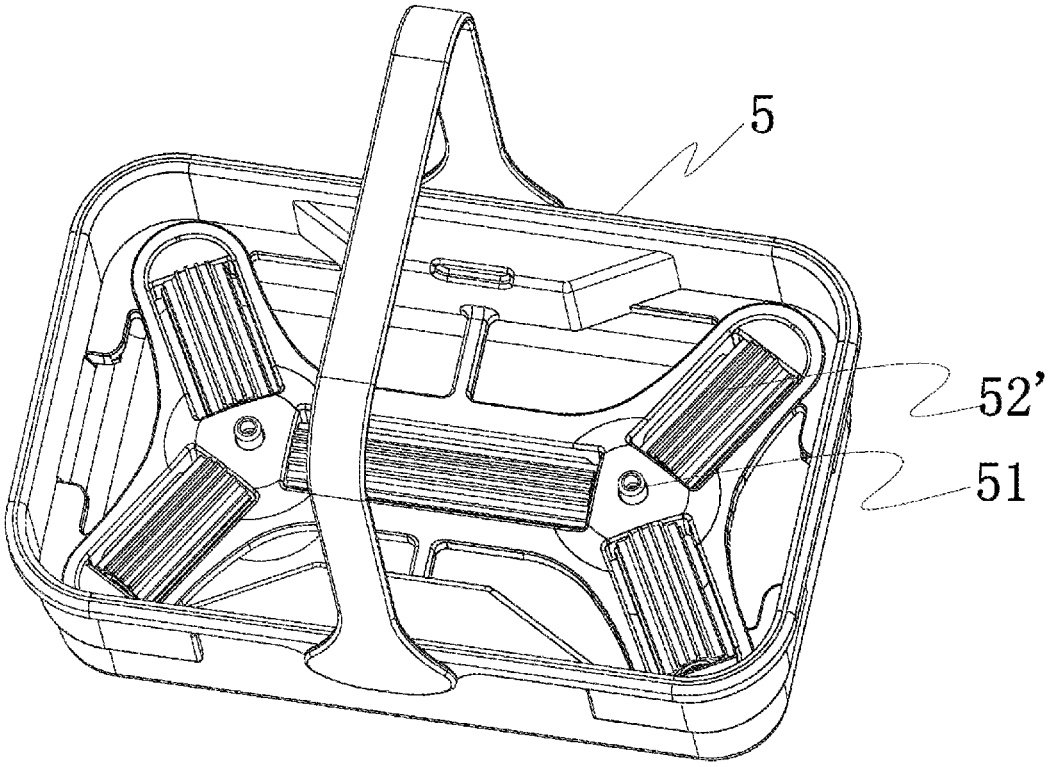
FIG. 5 is a structural diagram of a roller serving as a wiper member in the embodiment.

Preferably, in this embodiment, the wiper member 52 is a wiper strip, a roller 52', or a brush, or any combination of the wiper strip, the roller 52' and the brush, as shown in FIG. 5.

Preferably, in this embodiment, the wiper member 52 is a roller 52', the roller 52' is arranged in the barrel 5 with the self axis as a rotation axis and is able to rotate in one direction, and when the scrubbing disc 3 rotates forward, the roller 52' rotates synchronously; and when the scrubbing disc 3 rotates reversely, the roller 52' stop rotating. In a specific implementation, water is contained in the barrel 5 and exactly reaches the roller 52', the roller 52' rotates to bring water onto the scrubbing disc 3 and rubs with the scrubbing disc 3 to clean the scrubbing disc 3 efficiently.

Further preferably, the self-cleaning device further comprises a ratchet mechanism used for realizing unidirectional rotation of the roller 52'. The ratchet mechanism is a structure in the prior art. By adoption of the ratchet mechanism, the roller 52' can rotate in only one direction. When the roller 52' rotates, water is supplied to clean the scrubbing disc. The ratchet mechanism can lock the roller 52' to prevent the roller 52' from rotating reversely. By adoption of this structure, the scrubbing disc 3 can be cleaned with water when rotating forward and can be dried when rotating reversely.

Figure 6:
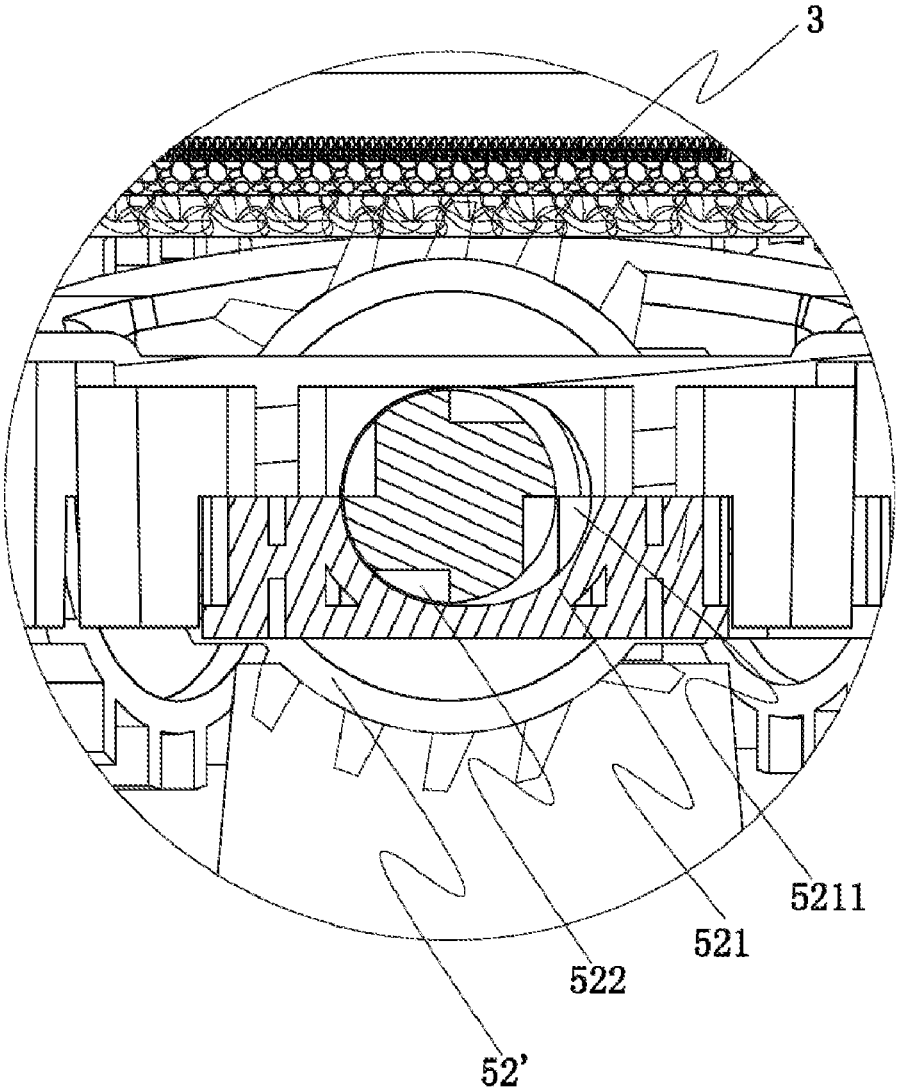
FIG. 6 is a structural diagram in a state where ratchet teeth are away from convex teeth in the embodiment.
Figure 7:
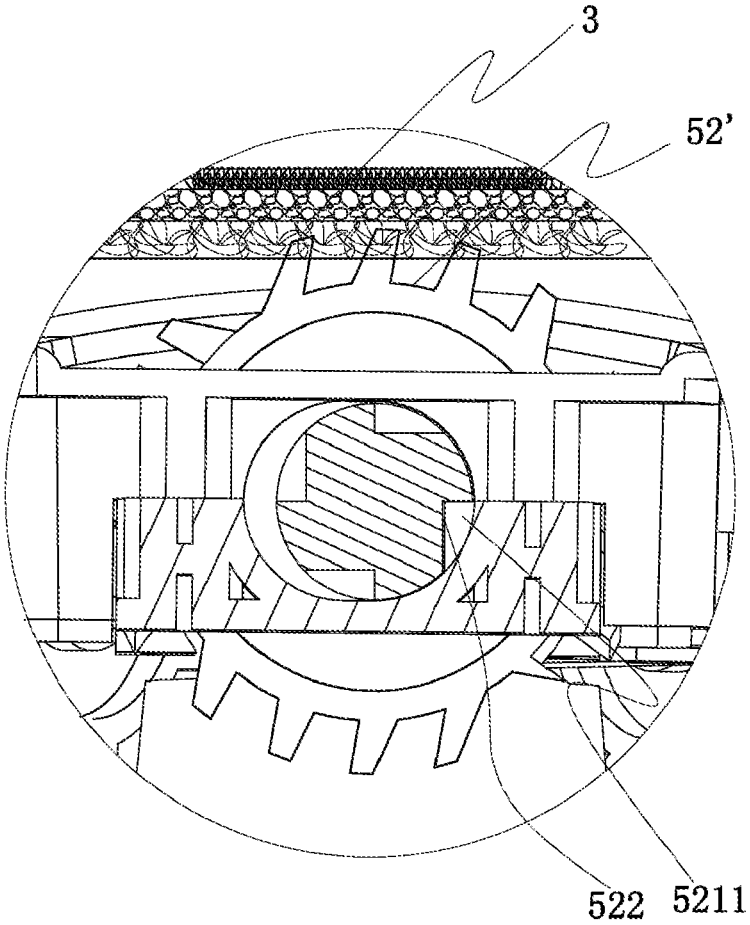
FIG. 7 is a structural diagram in a state where the convex teeth are embedded into the ratchet teeth in the embodiment.

In another implementation, the self-cleaning device preferably further comprises a mounting base 521, a rotary shaft is arranged at the end of the roller 52' and is provided with ratchet teeth 522, the mounting base 521 is provided with convex teeth 5211 and a cavity, the rotary shaft is arranged in the cavity, and the cavity has a movement space allowing the rotary shaft to move therein. As shown in FIG. 6, when the scrubbing disc 3 rotates forward, the rotary shaft rolls away from the convex teeth 5211. As shown in FIG. 7, when the scrubbing disc 3 rotates reversely, the rotary shaft rolls towards the convex teeth 5211 to allow the convex teeth 5211 to be inlaid into the ratchet teeth 522, and then the roller 52' is made to stop rotating. By adoption of this structure, the scrubbing disc 3 can be cleaned with water when rotating forward and can be dried when rotating reversely.

In this embodiment, the scrubbing disc 3 comprise a scrubbing part and a mounting disc used for mounting the scrubbing part, the motor 4 is connected to the mounting disc, and the scrubbing part is detachably arranged on the mounting disc. The mounting disc is provided with a hook-and-loop fastener capable of firmly hooking the scrubbing part, so that replacement is convenient.

In this embodiment, the scrubbing disc 3 comprise a scrubbing part and a mounting disc used for mounting the scrubbing part, the motor 4 is connected to the mounting disc, and the scrubbing part is sewn on the mounting disc. The scrubbing part can be smoothly sewn on the mounting disc.

In this embodiment, the scrubbing part is a microfiber fabric, PVA, a sponge, a cotton fabric, or the like.

Preferably, the self-cleaning device in this embodiment further comprises a water supply device used for supplying water to the scrubbing disc 3. The water supply device comprises a water pump. When the scrubbing disc 3 is to be cleaned with water, the water pump operates to pump water from the barrel 5 or from a water storage cavity isolated from the barrel 5 to the scrubbing disc 3, the scrubbing disc 3 rotates at the same time to abut against the wiper member 52 so as to be completely dried after being cleaned with water, and in this way, the scrubbing disc 3 is completely cleaned. The water pump in this embodiment is an electric pump or manual pump in the prior art and is used for delivering water.

Figure 8:
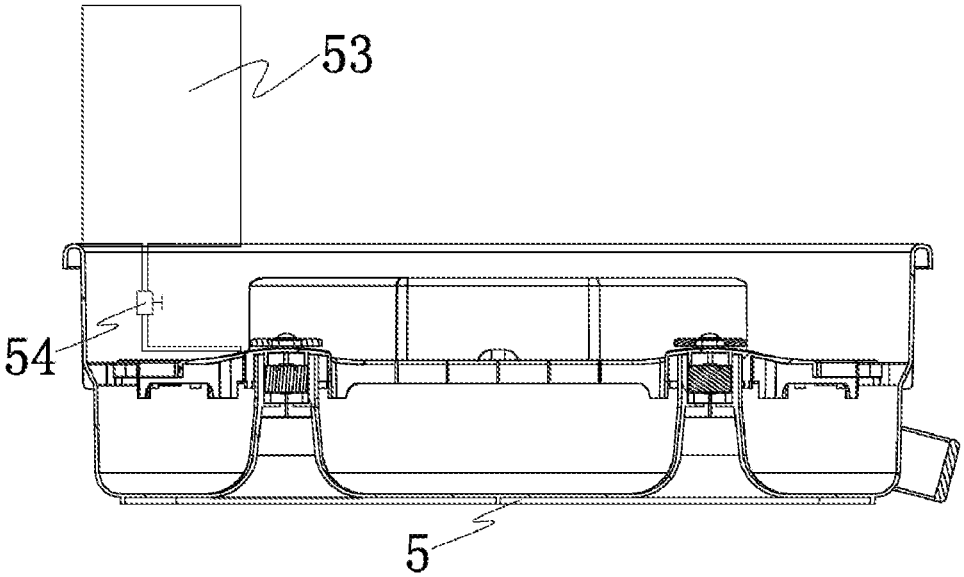
FIG. 8 is a structural diagram of a water receiver serving as a water supply device in the embodiment.

Preferably, as shown in FIG. 8, the self-cleaning device in this embodiment further comprises a water supply device used for supplying water to clean the scrubbing disc 3. The water supply device comprises a water receiver 53 connected to the barrel 5 and located above the scrubbing disc 3. The water receiver 53 is provided with a water outlet connected to a water valve 54. When the scrubbing disc 3 is to be cleaned with water, the water valve 54 is opened to allow water to be supplied to the scrubbing disc 3 via the water outlet, and water and/or dirt wiped off from the scrubbing disc 3 by the wiper member 52 are/is received in the barrel 5. As another implementation for supplying water to the scrubbing disc 3, in this embodiment, the water receiver 53 is arranged at a high position; when the scrubbing disc 3 is to be cleaned, the water valve 54 is opened to allow water to flow out towards the scrubbing disc 3, the scrubbing disc 3 rotates to abut against the wiper member 52 so as to be completely dried after being cleaned with water, and in this way, the scrubbing disc 3 can be completely cleaned.

Figure 9:
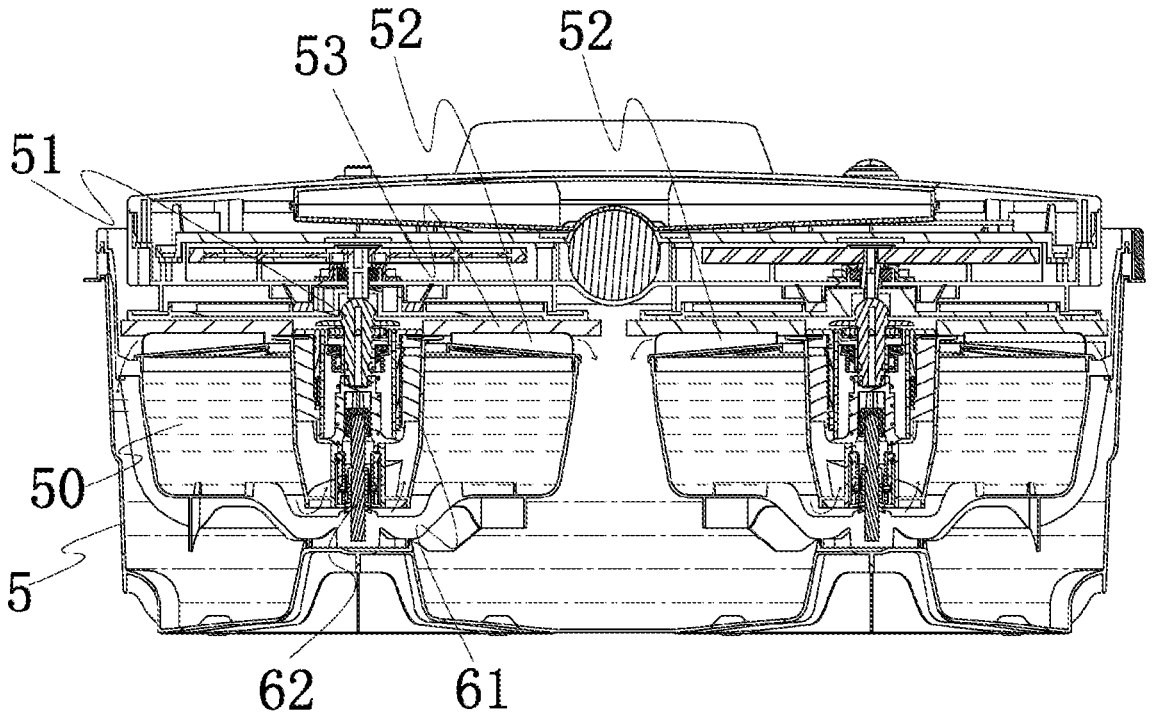
FIG. 9 is a structural diagram of the barrel having another water storage cavity in the embodiment.

Further preferably, in this embodiment, as shown in FIG. 9, the barrel 5 has a water storage cavity 50, the water pump operates to pump water from the water storage cavity 50 isolated from the barrel 5 to the scrubbing disc 3, and water and/or dirt wiped off from the scrubbing disc 3 by the wiper member 52 are/is received in the barrel 5. In this embodiment, the barrel has two water storage areas, wherein one water storage area stores dirty water, and the other water storage area stores clean water; and the water pump pumps the clean water, and water and/or dirt wiped off by the wiper member 52 flow(s) into the dirty water storage area, so that washing water and dirty water are separated, and cleaning water is greatly saved.

Figure 10:
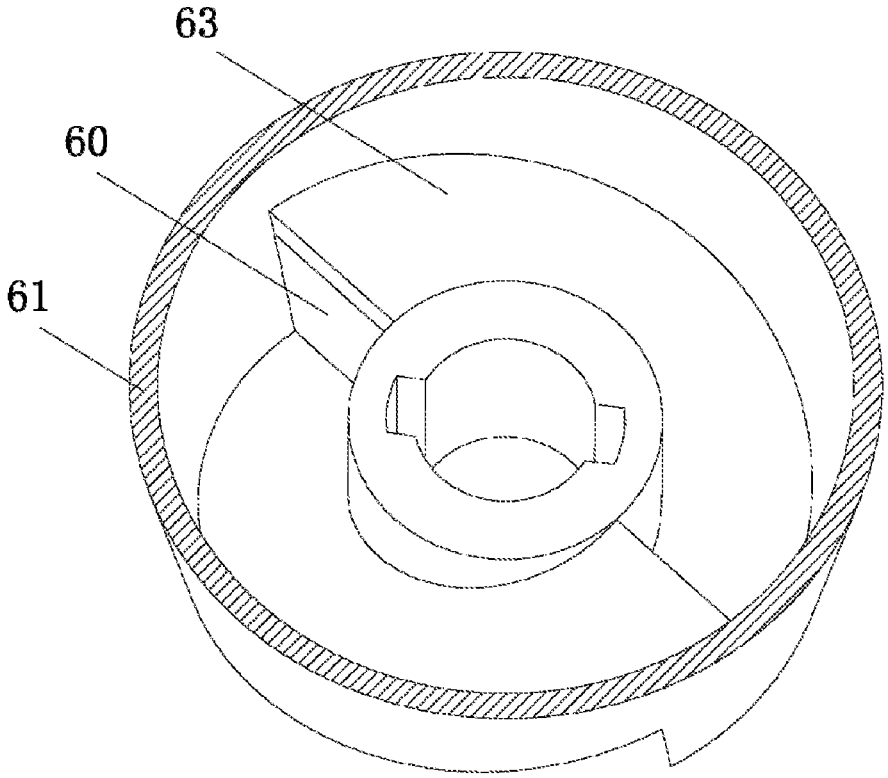
FIG. 10 is a structural diagram of one implementation of a water pump in the embodiment.

In this embodiment, as shown in FIG. 10, the water pump comprises a cylinder 61, wherein the cylinder 61 is provided with a water inlet 60, a spiral blade 63 which spirally extends along the inner wall of the cylinder 61 from bottom to top is arranged in the cylinder 61, the cylinder 61 is able to rotate with respect to the barrel 6, the scrubbing disc 3 is arranged above the cylinder 61 and makes contact with the cylinder 61, and when the scrubbing disc 3 rotates, the cylinder 61 is driven to rotate to lift water to the scrubbing disc 3. Further preferably, the upper portion of the cylinder 61 is connected to a connector, and the scrubbing disc 3 is arranged on the connector. Particularly, the connector has a pentagonal or hexagonal convex surface, and the scrubbing disc 3 has a pentagonal or hexagonal convex surface cavity matched with the connector; and after the connector is matched with the scrubbing disc 3, the cylinder 61 can be driven to rotate when the scrubbing disc 3 rotate. Compared with face-to-face friction, the driving efficiency is higher.

In this embodiment, the inner diameter of the cylinder 61 is increased from bottom to top, that is, the cylinder 61 is of a big-end-up structure; a slope is formed on the inner wall of the cylinder 61, so that water can be supplied more smoothly.

In this embodiment, the support member 51 is fixedly connected to the cylinder 61.

In this embodiment, an inner cylinder 62 is arranged in the cylinder 61, a gap is reserved between the inner cylinder 62 and the cylinder 61, and the inner cylinder 62 is coaxial with the cylinder 61 and is fixedly or rotatably connected to the cylinder 61.

In this embodiment, the inner cylinder 62 is fixedly connected to the cylinder 61, and the support member 51 is fixedly connected to the inner cylinder 62. In this embodiment, the inner cylinder 62 is used as a stress support point of the support member 51.

Figure 12:
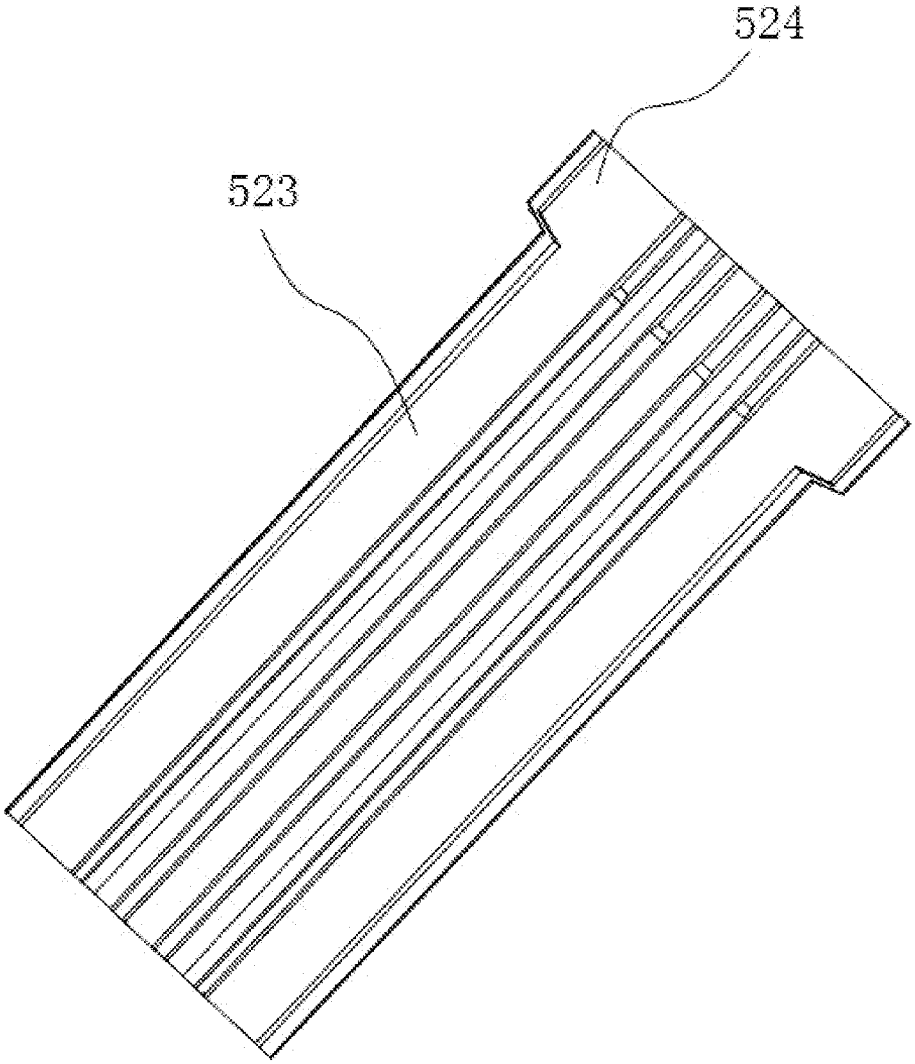
FIG. 12 is a partial view of the roller in the embodiment.

Preferably, as shown in FIG. 12, a plurality of first cleaning parts 523 are arranged on the outer surface of the roller 52' and are distributed in the circumferential direction of the roller 52', and particularly, the first cleaning parts 523 are convex ribs; and the self-cleaning device further comprises second cleaning parts 524 which are arranged corresponding to the edge of the scrubbing part, and the second cleaning parts 524 protrude with respect to the first cleaning parts 523. The first cleaning parts 523 and the second cleaning parts 524 are fixedly arranged on the outer surfaces of the roller 52'. The first cleaning parts 523 and the second cleaning parts 524 are circumferentially arranged in an array manner with the center of the roller 52' as a baseline. During cleaning, the second cleaning parts 524 and the first cleaning parts 523 make contact with the scrubbing part.

Figure 11:
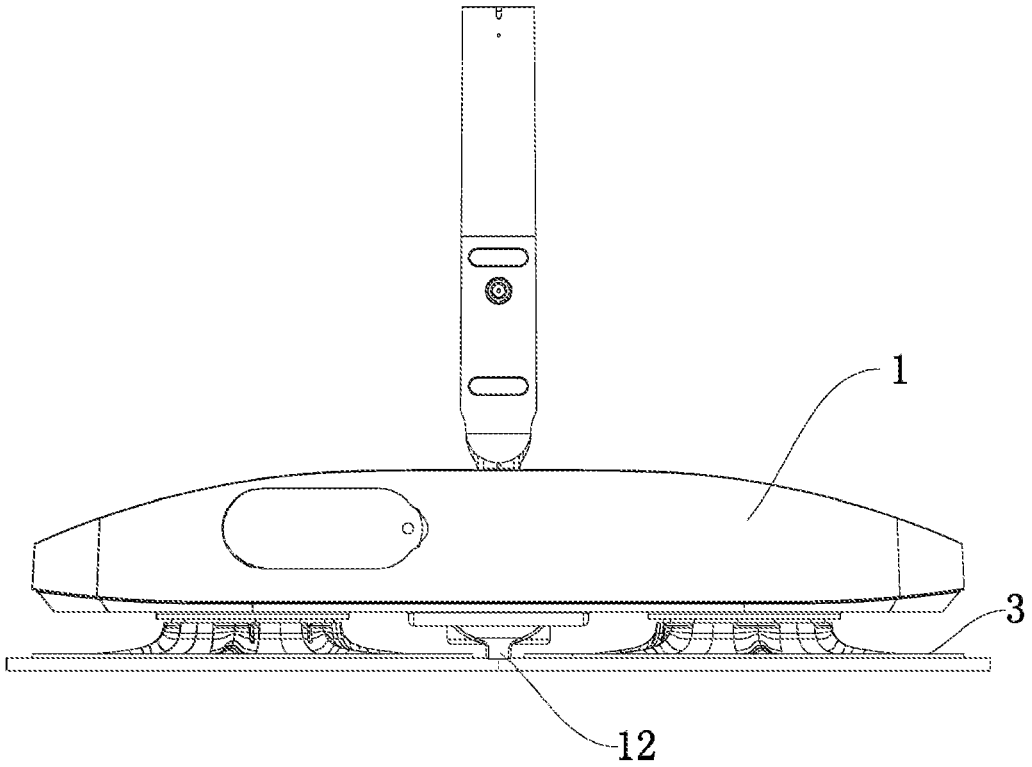
FIG. 11 is a front view of the floor scrubber in the embodiment.

Preferably, as shown in FIG. 11, a pressing rib 12 is arranged at the bottom of the housing 1 and is located between two scrubbing discs 3. In the scrubbing state, the pressing rib 12 is pressed against the scrubbing part to tightly attach the scrubbing part to the ground.

The embodiments are described by means of ideal schematic diagrams with reference to plane views and/or sectional views. These illustrative views can be modified according to the manufacturing technique and/or tolerance. The embodiments of the invention are not limited to those ones shown in the drawings, and all structural transformations obtained on the basis of the manufacturing process should be included in the invention. Areas shown in the drawings are illustrative, the shapes of the areas shown in the drawings can illustratively represent the shapes of the areas of parts, but the invention is not limited to these details shown in the drawings.

What is claimed is:

1. A cleaning assembly, comprising a floor scrubber and a self-cleaning device matched with the floor scrubber; wherein the floor scrubber comprises a housing connected to a handle, a motor is arranged in the housing, and a scrubbing disc is arranged under the housing and the scrubbing disc is driven by the motor to rotate; the self-cleaning device comprises a barrel, the barrel is connected to a support member configured to support the floor scrubber, and a wiper member is arranged in the barrel; when the floor scrubber is placed in the barrel to be dried, the support member supports the floor scrubber, and the wiper member abuts against the scrubbing disc; and when the scrubbing disc rotates or the wiper member moves, water and/or dirt on the scrubbing disc are/is wiped off by the wiper member, wherein the wiper member is a roller, and the roller is rotatably arranged in the barrel with a self axis as a rotation axis and the roller is configured to rotate in one direction; when the scrubbing disc rotates forward, the roller rotates synchronously and brings water onto the scrubbing disc; and when the scrubbing disc rotates reversely, the roller stops rotating and dries the scrubbing disc, and wherein water is contained in the barrel for water to reach the roller, the roller rotates to bring water onto the scrubbing disc and the roller rubs with the scrubbing disc to clean the scrubbing disc.

2. The cleaning assembly according to claim 1, wherein an even number of the scrubbing discs are arranged and are divided into two symmetrical groups, and the two symmetrical groups of the scrubbing discs rotate in opposite directions.

3. The cleaning assembly according to claim 1, wherein the support member is arranged in the barrel.

4. The cleaning assembly according to claim 1, wherein the support member is arranged above the barrel, the handle is provided with a hanging part, and the support member is connected to the hanging part to support the floor scrubber.

5. The cleaning assembly according to claim 1, wherein the scrubbing disc is a circular disc and rotates, and the wiper member is maintained in the barrel.

6. The cleaning assembly according to claim 1, wherein the scrubbing disc is a circular disc, and the wiper member is rotatably arranged with a center of the scrubbing disc as a rotation point.

7. The cleaning assembly according to claim 1, wherein the self-cleaning device further comprises a ratchet mechanism, and the ratchet mechanism is configured to realize an unidirectional rotation of the roller.

8. The cleaning assembly according to claim 1, wherein the self-cleaning device further comprises a mounting base, a rotary shaft is arranged at an end of the roller and the rotary shaft is provided with ratchet teeth, the mounting base is provided with convex teeth and a cavity, the rotary shaft is arranged in the cavity, and the cavity comprises a movement space, and the rotary shaft moves in the movement space; when the scrubbing disc rotates forward, the rotary shaft rolls away from the convex teeth; and when the scrubbing disc rotates reversely, the rotary shaft rolls towards the convex teeth to allow the convex teeth to be inlaid into the ratchet teeth, and the roller is made to stop rotating.

9. The cleaning assembly according to claim 1, wherein the scrubbing disc comprises a scrubbing part and a mounting disc configured to mount the scrubbing part, the motor is connected to the mounting disc, and the scrubbing part is detachably arranged on the mounting disc.

10. The cleaning assembly according to claim 1, wherein the scrubbing disc comprises a scrubbing part and a mounting disc configured to mount the scrubbing part, the motor is connected to the mounting disc, and the scrubbing part is sewn on the mounting disc.

11. The cleaning assembly according to claim 1, wherein the inner cylinder is fixedly connected to the cylinder, and the support member is fixedly connected to the inner cylinder.

12. The cleaning assembly according to claim 1, wherein a first cleaning body and a second cleaning body are circumferentially arranged in an array manner with a center of the roller as a baseline, and the second cleaning body is arranged corresponding to an edge of a scrubbing part and the second cleaning body protrudes with respect to the first cleaning body.

13. The cleaning assembly according to claim 1, wherein a pressing rib is arranged at a bottom of the housing and the pressing rib is located between two scrubbing discs, and in a floor scrubbing state, the pressing rib is pressed against a scrubbing part to tightly attach the scrubbing part to a ground.

* * * * *